US007163492B1

(12) United States Patent
Sotiriades

(10) Patent No.: US 7,163,492 B1
(45) Date of Patent: Jan. 16, 2007

(54) PHYSICAL THERAPY WALKING EXERCISE APPARATUS

(76) Inventor: Aleko D. Sotiriades, W62 N. 1026 Fairhaven Ct., Cedarburg, WI (US) 53012

( * ) Notice: Subject to any disclaimer, the term of this patent is extended or adjusted under 35 U.S.C. 154(b) by 391 days.

(21) Appl. No.: 10/890,899

(22) Filed: Jul. 15, 2004

(51) Int. Cl.
*A63B 22/00* (2006.01)

(52) U.S. Cl. ..... 482/51; 482/69; 601/5; 607/49

(58) Field of Classification Search ..... 482/51, 482/52, 57–63, 66, 68–70, 79, 80, 92, 143; 601/1, 5, 29, 31–35; 602/2, 10, 23; 434/255; 607/49

See application file for complete search history.

(56) References Cited

U.S. PATENT DOCUMENTS

| | | | | | |
|---|---|---|---|---|---|
| 219,439 | A * | 9/1879 | Blend | 601/23 |
| 2,210,269 | A * | 8/1940 | Taylor | 601/33 |
| 3,824,994 | A * | 7/1974 | Soderberg, Sr. | 601/29 |
| 4,973,044 | A * | 11/1990 | Jones | 482/51 |
| 5,192,257 | A * | 3/1993 | Panasewicz | 482/70 |
| 5,368,533 | A * | 11/1994 | Feuer et al. | 482/70 |
| 5,573,480 | A * | 11/1996 | Rodgers, Jr. | 482/57 |
| 5,683,333 | A | 11/1997 | Rodgers, Jr. | |
| 5,941,800 | A * | 8/1999 | Laconis | 482/70 |
| 6,077,196 | A * | 6/2000 | Eschenbach | 482/51 |
| 6,422,977 | B1 | 7/2002 | Eschenbach | |
| 6,612,969 | B1 | 9/2003 | Eschenbach | |
| 6,629,909 | B1 | 10/2003 | Stearns | |
| 6,648,801 | B1 * | 11/2003 | Stearns et al. | 482/52 |
| 6,652,423 | B1 | 11/2003 | Chen | |
| 6,672,992 | B1 * | 1/2004 | Lo et al. | 482/52 |
| 6,689,075 | B1 * | 2/2004 | West | 601/23 |
| 6,719,665 | B1 * | 4/2004 | Lai | 482/52 |
| 6,719,666 | B1 | 4/2004 | Lo | |
| 6,821,233 | B1 * | 11/2004 | Colombo et al. | 482/54 |
| 7,041,069 | B1 * | 5/2006 | West | 601/5 |
| 2004/0097330 | A1 * | 5/2004 | Edgerton et al. | 482/1 |
| 2004/0116839 | A1 * | 6/2004 | Sarkodie-Gyan | 601/35 |
| 2005/0101448 | A1 * | 5/2005 | He et al. | 482/54 |

* cited by examiner

*Primary Examiner*—Jerome Donnelly
*Assistant Examiner*—Tam Nguyen
(74) *Attorney, Agent, or Firm*—Robert T. Johnson

(57) ABSTRACT

Physical therapy walking exercise apparatus is disclosed and includes a gear motor driven V belt sheave a V belt on the V belt sheave and the V belt extending to fit on a driven fly wheel, beams concentrically attached to the axle leg of the driven fly wheel and foot placement shoes mounted on the beams and knee stabilizer attachment pads attached to rods reciprocating on actuation of the apparatus assembly and electrical stimulation leads extending to electrodes for attachment to thighs of the patient.

2 Claims, 6 Drawing Sheets

PHYSICAL THERAPY WALKING EXERCISE APPARATUS

BACKGROUND OF THIS INVENTION

Exercising of the muscle in a human body is of utmost importance to maintain an active life, and those unable to do so, voluntarily, can be enabled to exercise by walking with the aid of physical therapy exercise apparatus of this invention, for re-training a patient to walk.

SUMMARY OF THIS INVENTION

Physical therapy exercise apparatus of this invention includes a base for mounting the components of a gear motor drive, a V belt sheave attached to the gear motor drive, a V belt on the V belt sheave attached to the gear motor drive and the V belt extending, to a driven fly wheel, and two beams, each hinged on one end, and each beam concentrically attached to the driven fly wheel axle leg, a foot placement shoe mounted on each of the beams, and the hinged ends of each beam attached to a separate pivot mounted lever, and a handle bar attached to each pivot mounted lever. Knee stabilizer attachment pads, attached to reciprocating pivoted rods, on actuation of the apparatus, and a control panel mounted on an upright pillar between handle bars. A back rest mounted on a vertically adjustable height pillar. A gantry crane head mounted on a horizontal beam attached to a vertical adjustable height and the horizontal beam, pivoting or movable, in a horizontal plane, and electrodes attached to the patient/manikin thighs, and leads to the electrodes extending from a monitor to control the electric stimulation frequency and amount of electrical charge.

PRIOR ART CONSIDERED (U.S. PATENTS)

U.S. Pat. No. 6,648,801 for EXERCISE APPARATUS WITH ELLIPTICAL MOTION.

U.S. Pat. No. 6,652,423 for EXERCISE MACHINE.

U.S. Pat. No. 6,551,219 for CYCLIC ERGOMETER.

U.S. Pat. No. 6,612,069 for VARIABLE STRIDE ELLIPTICAL STRIDE

U.S. Pat. No. 6,422,977 for ELLIPTICAL EXERCISE MACHINE

U.S. Pat. No. 6,629,909 for ELLIPTICAL EXERCISE APPARATUS

U.S. Pat. No. 6,719,666 for EXERCISING DEVICE ELLIP. FOOT MOVEMENT

U.S. Pat. No. 5,683,333 for STATIONARY EXERCISE APPARATUS

U.S. Pat. No. 4,705,028 for BODY STIMULATING MECH. JOGGER.

None of the above cited patents either singly or collectively, would anticipate or make obvious the invention of this application.

LEGEND

Figure 1:
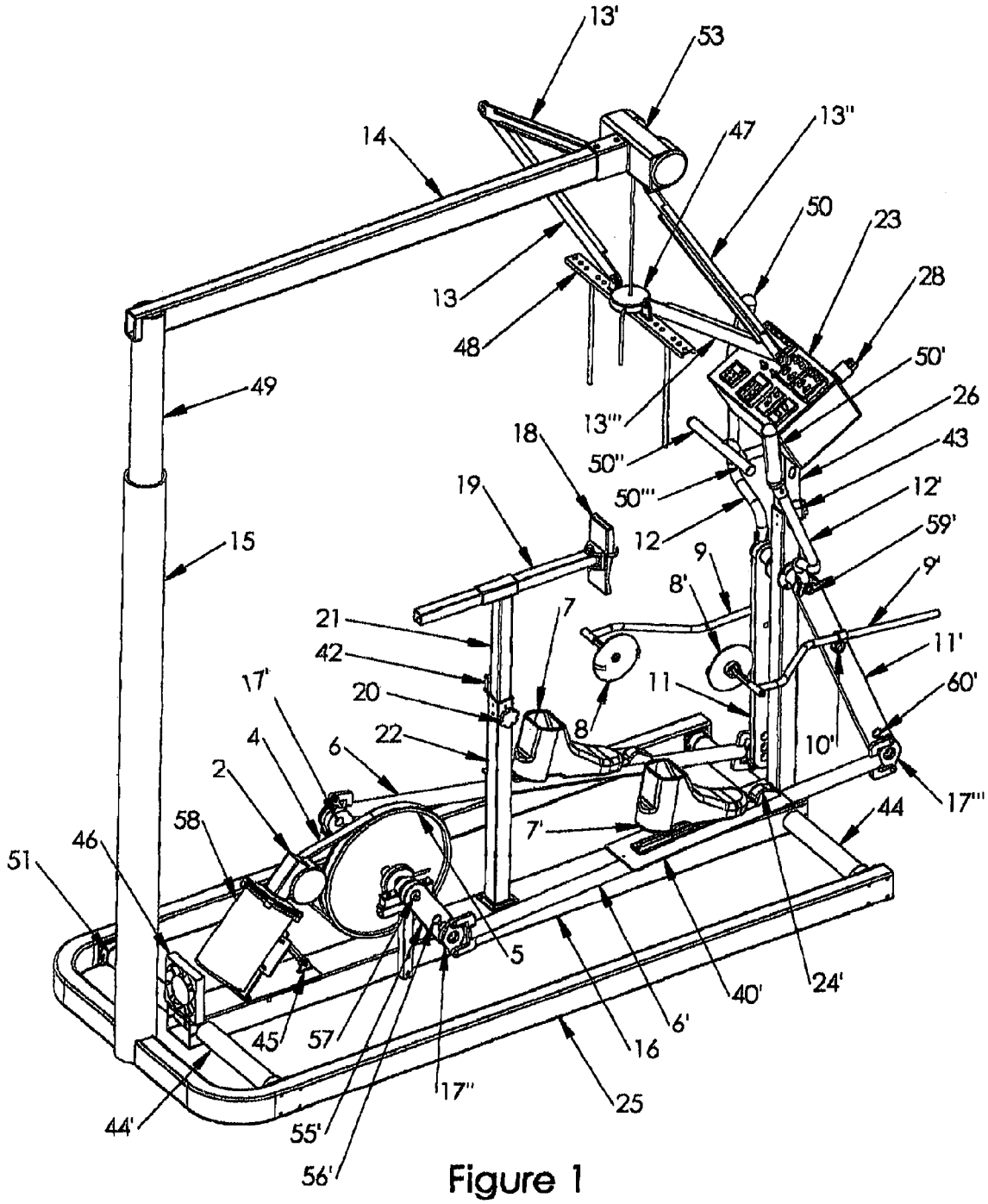
FIG. 1—Elevation right side view of physical therapy exercise apparatus.

1—Physical therapy exercise apparatus
2—Motor & gearbox drive unit
3—Gearbox output drive sheave
4—V-belt
5—Driven flywheel/sheave
6, 6'—Drive beams for boot binding mounting brackets
7, 7'—Toe hinged boot bindings
8, 8'—Knee stabilizer attachment pads
9, 9'—Knee stabilizer reciprocating guide rods
10, 10'—Guide rod bearings
11, 11'—Drive beam linkage arms
12, 12'—Vertical handle bars
13, 13', 13", 13'"—Body lift stabilizer
14—Horizontal crane arm (rotating & vertical sliding)
15—Vertical crane pillar
16—Base frame for physical therapy exercise apparatus
17, 17'—Concentric flanged bearing mount
18—Hip stabilizer & back rest pad
19—Horizontal extension & mounting arm for back rest
20—Locking clamp
21—Vertical extension back rest pad mount pillar
22—Vertical back rest pad pillar
23—Control panel
24, 24'—Boot bindings with boot pivot bearings
25—Base frame for crane
26—Vertical extension support for control panel
27—Manikin
28—Power cord with connecting ends
29—Remote motor control switch
30—Rehabilitation session timer, with display g) On/off button r) Program mode button s) Set hours button t) Set minutes button
31—Motor drive control key pad and display g) Program mode button h) Forward reverse button i) Run or start button j) Faster button k) Slower button l) Stop button
32—Main power on/off switch with indicator light
33—Ground fault circuit interrupter u) GFCI test switch v) GFCI reset switch
34—Muscle stimulation units m) Frequency modulation control dial n) Intensity & duration control dial o) On/off switch p) Program selection dial w) Electrodes (W, W', W", W'")
35—Load cell cable connector
36—Load cell display meter a) Alarm-1 set-point adjustment b) Alarm-1 hysteresis adjustment c) Alarm-2 set-point adjustment d) Alarm-2 hysteresis adjustment e) Span adjustment f) Offset adjustment
37—On/off switch for load cell meter
38—Fuse holder
39—Hand held remote keypad and display cable connector
40, 40'—Boot binding mounting bracket
41—Horizontal handle bars (adjustable, stationary)
42—Photoelectric light beam emitter
43—Photoelectric light beam receiver
44—Rehabilitation apparatus support tubes
45—Motor & gearbox adjustable mounting bracket
46—Motor & gearbox cooling fan
47—Load cell
48—Lift bar
49—Vertical crane arm support (adjusts vertically)
50, 50'—Safety switches

51, 51', 51", 51'"—Couplings to join rehabilitation apparatus to floor frame
52—Computer interface female connector
53—Winch assembly
54—Heel cycle travel contour
54'—Toe cycle travel contour
55, 55'—Drive arms
56, 56'—Apertures in drive arms
57—Axle of driven sheave
58—Electric motor of gearbox drive
59, 59'—Swing bearings for drive beam linkage arms
60, 60'—Apertures in drive beam linkage arms
61—Photoelectric beam pathway

DETAILED DESCRIPTION OF INVENTION

Figure 2:
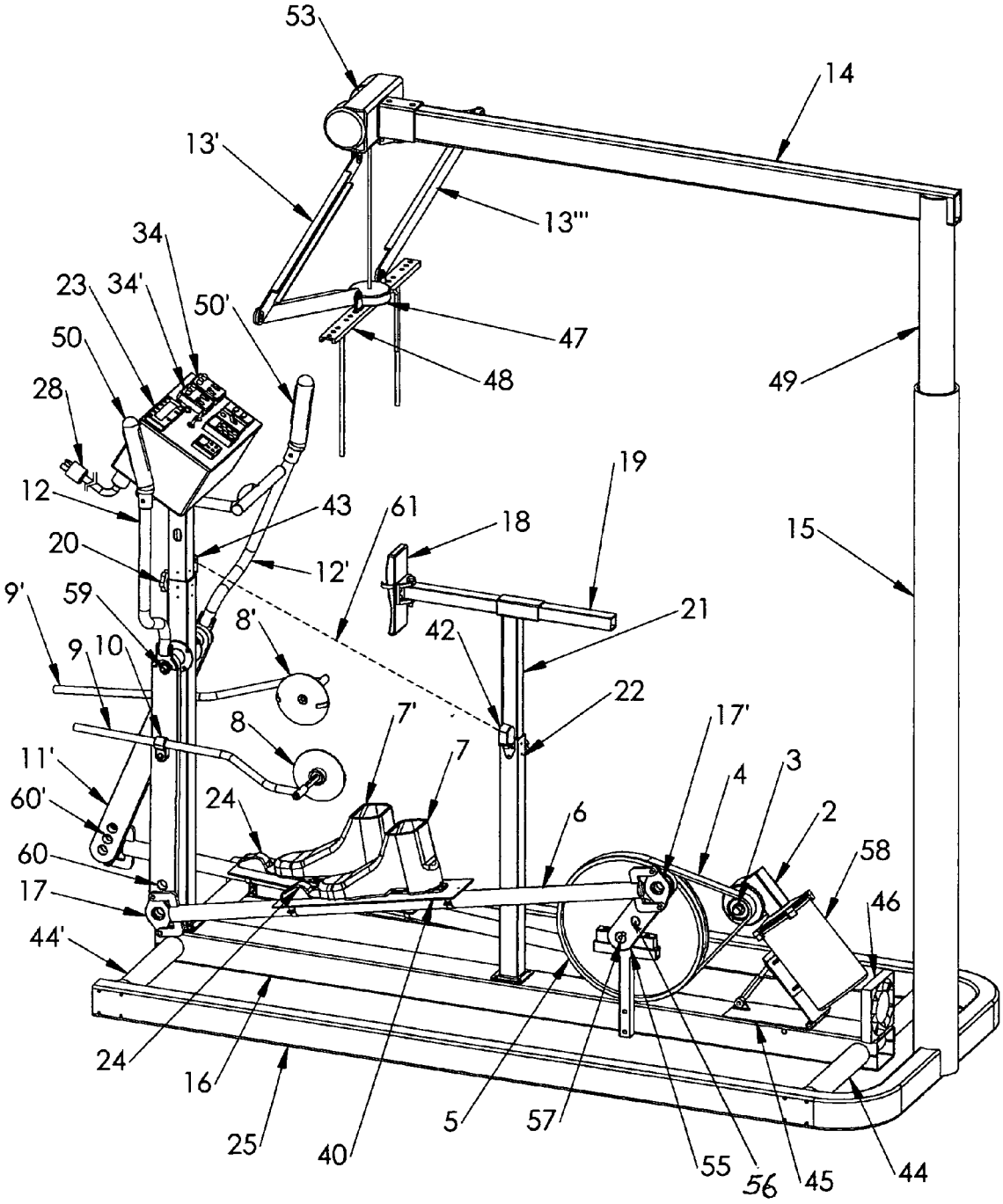
FIG. 2—Left side elevation view of physical therapy exercise apparatus

The physical therapy exercise apparatus of this invention can be described by reference to FIGS. 1 and 2 showing this application 1, and includes a base frame 16 for the apparatus a motor and gearbox drive unit 2, and gearbox output drive sheave 3, and V belt 4, mounted on gearbox output drive sheave 3, and the driven flywheel sheave 5. One end of each of drive beams 6, 6' are attached to drive arms 55, 55', in turn attached to axle 57 of driven flywheel sheave 5, the opposite ends of each of drive beams 6, 6' are connected to drive beam linkage arms 11, 11' by means of a flanged bearing mounts 17. Handle bars 12, 12' attached to drive beam linkage arms 11, 11' extend upward, and safety switches 50, 50' mounted on handle bars 12, 12'.

Boots 7, 7' mounted on boot toe bindings 24, 24' attached to drive beams 6, 6' to allow tilting of the boots 7, 7' on actuating of the apparatus 1, by electric motor 58, of motor and gearbox drive unit 2 mounted on bracket 45.

Figure 4:
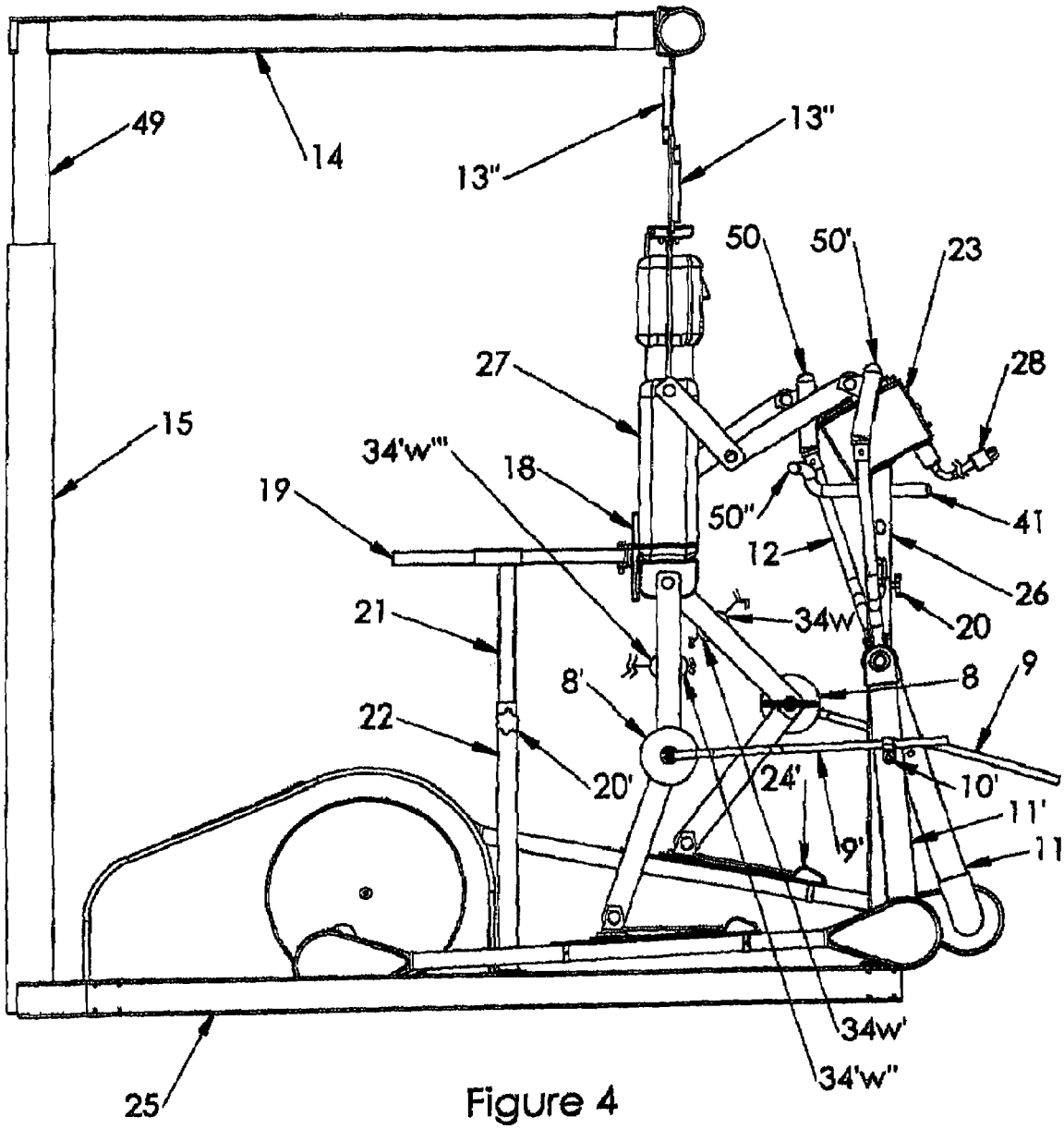
FIG. 4—Side elevation view of manikin in the physical therapy exercise apparatus FIG. 5—Plan view of physical therapy exercise apparatus.

Referring now to FIG. 4, showing manikin 27, in standing position in apparatus 1, and the manikin 27 lifted in position by means of body lift stabilizer 13, extending from horizontal crane arm 14, attached to vertical crane pillar 49. Hip stabilizer and back rest pad 18, is to abut the manikin (patient) as shown in this FIG. 4 and is adjustable by being mounted on horizontal extension and mounting arm 19, and this vertical extension arm 19 attached to telescoping vertical extension back rest pillar 21, telescoping into vertical back rest pillar 22 The feet of the manikin (patient) are to be placed in boots 7, 7', as shown in FIGS. 1 and 2, mounted on toe bindings attached to drive beams 6, 6'. It is to be noted that boots 7, 7' to be mounted on toe bindings are not shown in FIG. 4.

As noted above, this apparatus is for physical therapy, particularly for re-training the patient, to walk, and includes knee stabilizer attachment pads 8, 8' attached to knee stabilizer reciprocating guide rods 9, 9', and each reciprocating guide rod 9, 9' extending through guide rod bearings 10, 10' which prevents side wobble of the patients knees on actuation of the apparatus 1. The above noted knee stabilizer attachment pads 8, 8' are strapped onto the outside of the patients knees, to prevent knee wobble.

Body lift stabilizer 13, hangs downward from winch assembly 53, attached to horizontal crane arm 14. The crane arm 14, mounted on telescoping vertical crane pillar 49, telescoping into vertical crane arm support 15, and the vertical crane pillar 15 mounted on base frame 25 for the crane and physical therapy rehabilitation/exercise apparatus 1. Lift bar 48 attached to body lift stabilizer 13.

Figure 3:
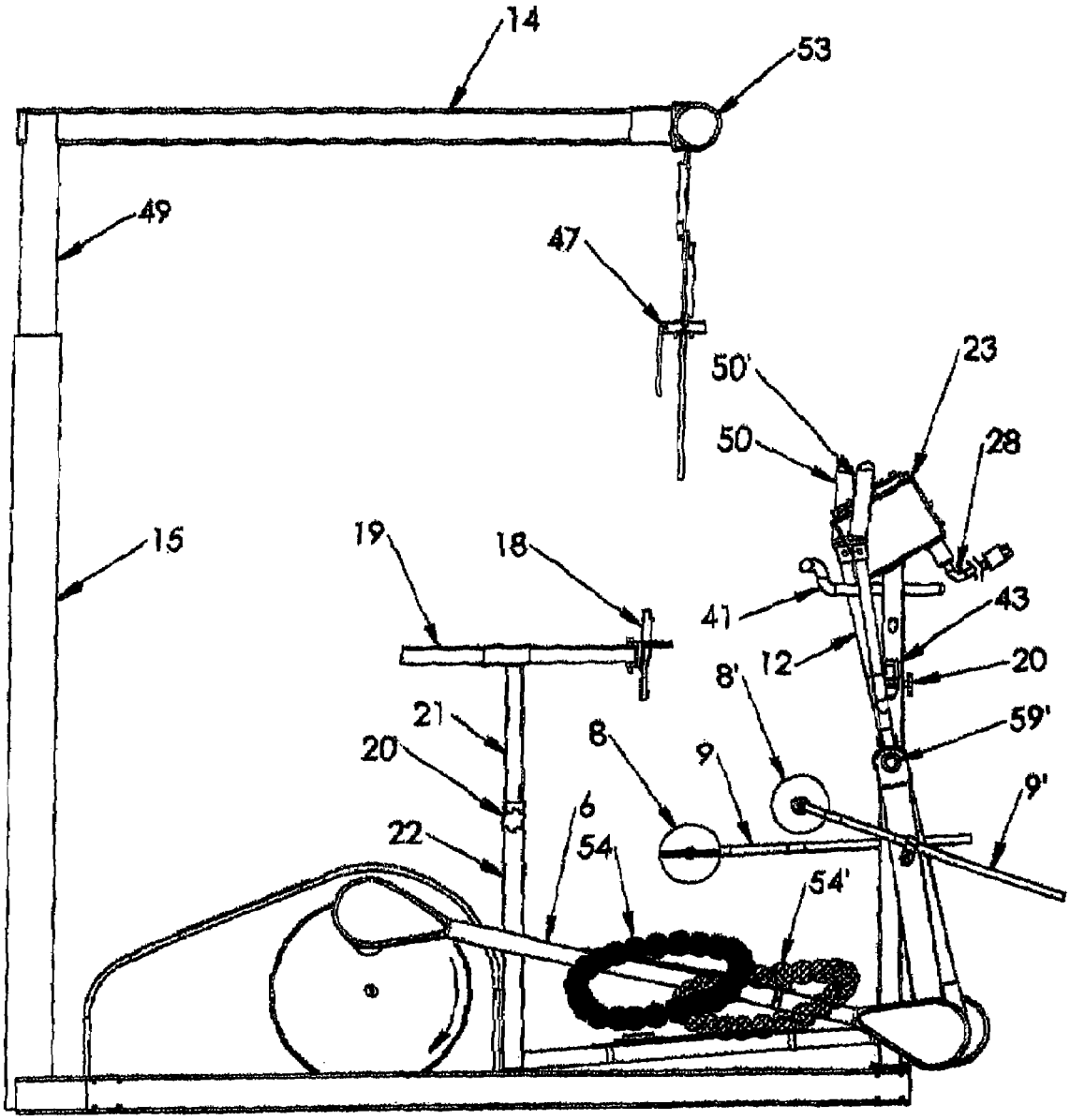
FIG. 3—Side elevation view of foot action contour.

FIG. 3 is a side elevation view to show in particular the heel cycle travel contour 54 and toe cycle travel contour 54', of a patients' foot and boot 7, or 7' on activation of the therapy rehabilitation/exercise apparatus 1.

Figure 5:
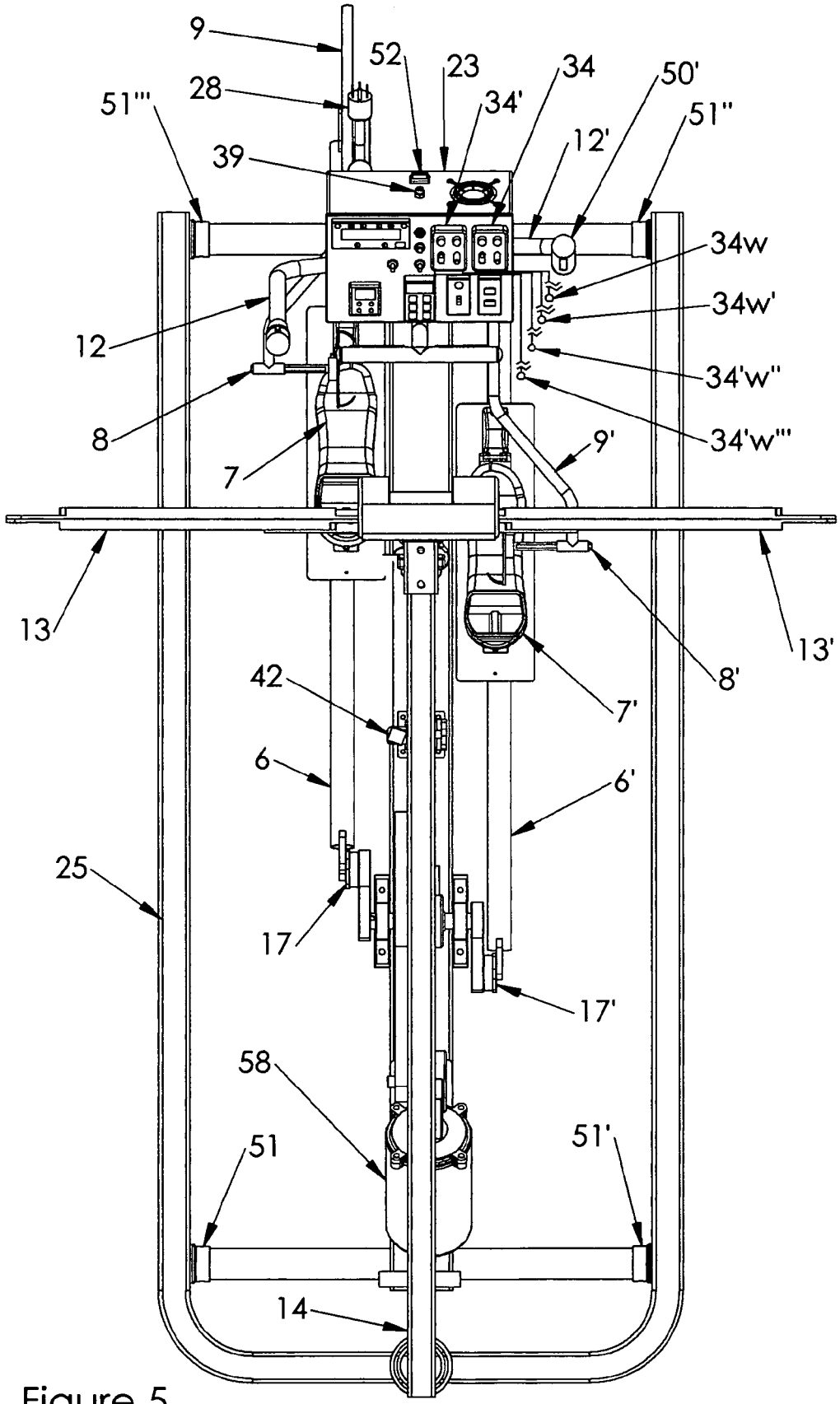
Figure 6:
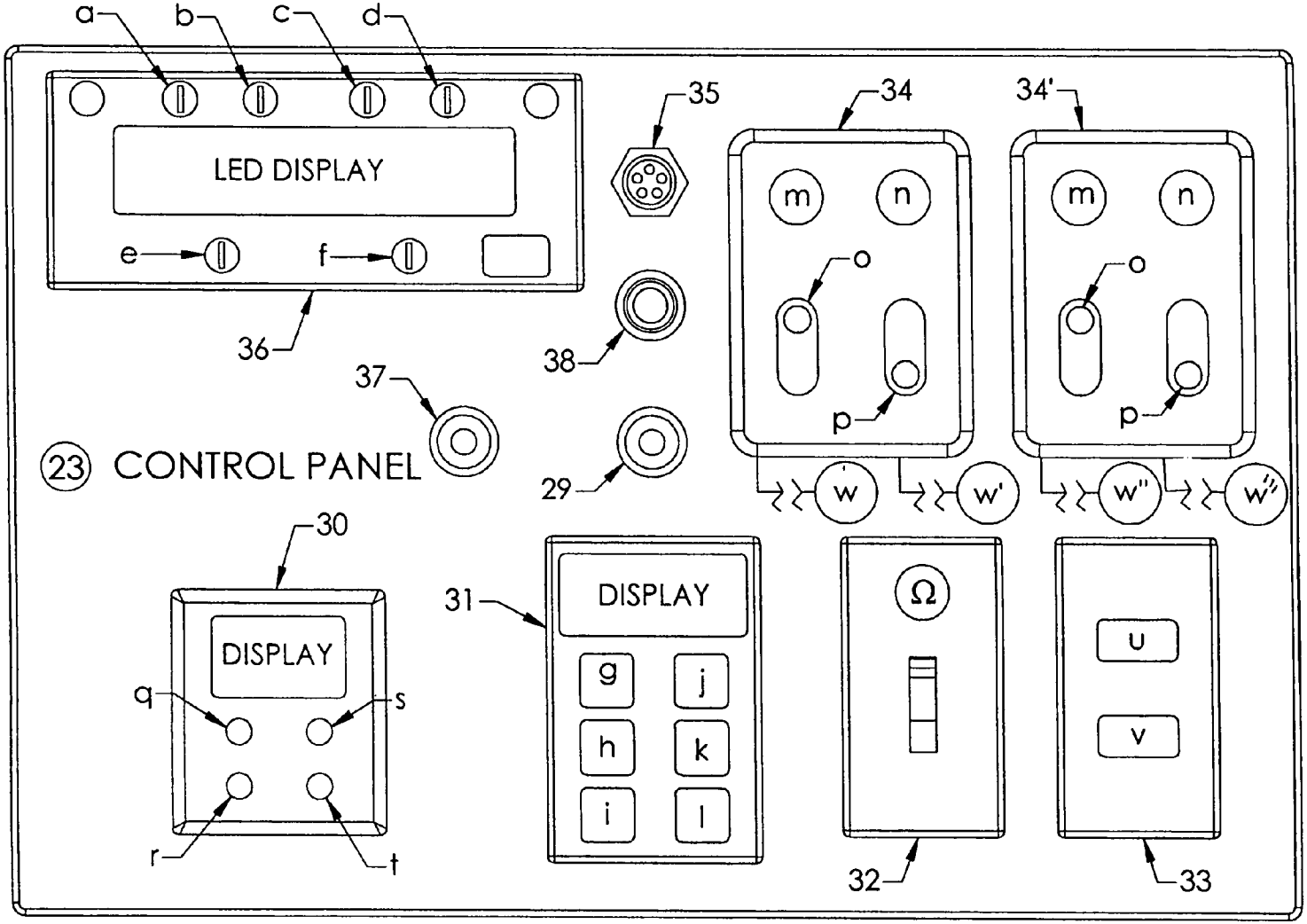
FIG. 6—Physical therapy exercise apparatus control panel.

FIG. 5, is a plan view of the physical therapy rehabilitation/exercise apparatus 1, and shows the physical therapy rehabilitation/exercise apparatus 1, connected to base frame 25, by means of couplings 51, 51', 51", 51'" attached to connector tubes 44, 44' for stability 0010—Control panel 23, is mounted on telescoping vertical support 26. Referring to FIG. 6, the components are as follows.

Rehabilitation session timer 30, which display includes q—on/off button; r—program mode button; s—set hours button; t—set minutes button.

Motor drive control key pad and display 31, which display includes: g—program mode button: h—forward/reverse button: i—start button: j—faster button: k—slower button: l—stop button.

Main power on/off switch with indicator light 32.

Ground fault circuit interrupter 33, which includes: u—ground fault circuit interrupter test switch: v—ground fault circuit interrupter reset switch.

Muscle stimulation units 34, which includes: m—frequency modulation control dial: n—intensity and duration control dial: o—on/off switch: p—program selection dial.

Load cell cable connector 35.

Load cell display meter 36, which includes: a—alarm—1 set point adjustment: b—alarm—1 hysteresis adjustment: c—alarm—2 set-point adjustment: d—alarm—2 hysteresis adjustment: e—span adjustment: f—offset adjustment.

On/off switch for load cell meter 37, and fuse holder 38.

Power cord 28 with male plug extends from control panel 23. Remote motor control switch 29 is mounted in control panel 23.

Referring to the physical therapy rehabilitation/exercise apparatus 1, boot binding mounting brackets 40 for boots to be mounted on boot toe bindings, to allow for raising of the heel on going through the walk step. Horizontal handle bar 41, connected to vertical extension support for control panel 26.

FIG. 5, shows the plan view of the physical therapy rehabilitation/exercise apparatus 1, and braces 44, 44' attaching the above mentioned apparatus 1, to the base frame 25 for stability.

The motor and gearbox mounting bracket 45, is for adjusting the tension of the V-belt 4. Motor 58, motor gearbox drive unit 2, and cooling fan 46, are mounted as shown in FIGS. 1 and 2.

Load cell 47, mounted on body lift stabilizer 13 adjacent to the lift bar 48 to control the proper weight load to the feet of the patient, in the physical therapy walking exercise apparatus of this invention.

Drive arms 55, 55' are attached to the axle 57 of driven sheave and apertures 56, 56' are provided in the drive arms 55, 55' to adjust the stride of the patient in the therapy apparatus.

Drive beam linkage arms 11, 11' are mounted on swing bearings 59, 59' for the drive beam linkage arms, and vertical handlebars 12, 12' are attached to the drive beam linkage arms 11, 11', to give a natural swing of the arms in opposite direction to foot movement.

Electrotherapy is part of this apparatus for walking and on referring to FIG. 5, wherein muscle stimulation units 34, 34' are shown, which connect to electrode leads W, W', W", W'" that connect to electrodes placed on thighs of manikin/patient as shown in FIG. 4. The control of this electrotherapy is through muscle stimulation units 34, 34'.

Photoelectric light beam emitter 42, mounted on vertical back rest pad mount pillar 22, aimed at photoelectric light beam receiver 43, is a safety feature to allow the apparatus to operate only when the photoelectric beam pathway is blocked by the manikin/patient.

Apertures 60, 60' in drive beam linkage arms 11, 11' (see FIGS. 1, 2) can be used to adjust the walk step.

Referring to FIG. 5, legend 52 is a computer interface female connector for data information recording and tracking, and is mounted on the control panel 23.

Having described my invention, I claim:

1. A physical therapy walking exercise apparatus comprising:

a) a base frame;

b) a gear motor drive, having a drive sheave, mounted on said base frame;

c) a driven flywheel, including a V-belt sheave and an axle, mounted on the base frame;

d) a V-belt mounted on the gear motor drive sheave extends to and around the driven flywheel such that the flywheel is rotated by the gear motor drive;

e) two drive beams, each hinged at one end to a drive beam linkage arm and concentrically attached at the other end to the axle of the flywheel;

f) a toe hinged boot binding and boot movably attached to each of the drive beams;

g) a handle bar attached to each of the drive beam linkage arms;

h) a separate knee stabilizer attachment pad is attached to a knee stabilizer reciprocating guide rod that is movably coupled to each of the drive beam linkage arms;

i) a control panel mounted on an upright pillar located between the handle bars;

j) a back rest mounted on a first vertically height adjustable pillar;

k) a patient lift device that includes a lift bar, a winch and a horizontal beam attached to a second vertically height adjustable pillar that is secured at a rear portion of the base frame wherein the horizontal beam is pivotally movable in a horizontal plane;

l) a plurality of electrical leads extending from a monitor panel of the control panel wherein the leads can be attached to electrodes on a patient to stimulate the patient's thigh muscles; and m) a light beam emitter located on the first vertically height adjustable pillar and a light beam receiver located on the upright pillar wherein the emitter and the receiver provides a safety feature by allowing the apparatus to be operational only when a light beam from the emitter to the receiver is blocked by a patient.

2. The exercise apparatus of claim 1 wherein the control panel further comprises:

a) a rehabilitation session timer and display;

b) a motor drive control key pad and display;

c) a main power on/off switch and indicator light;

d) a ground fault circuit interrupter;

e) muscle stimulator units;

f) a load cell cable connector;

g) a load cell display meter; and h) a computer interface female connector.

* * * * *